US006877229B2

(12) United States Patent
Sakai

(10) Patent No.: US 6,877,229 B2
(45) Date of Patent: Apr. 12, 2005

(54) KNIFE WITH FUNCTION OF SCISSORS

(75) Inventor: Kimiyuki Sakai, Gifu-ken (JP)

(73) Assignee: Geber Sakai Co., Ltd, Gifu-Ken (JP)

( * ) Notice: Subject to any disclaimer, the term of this patent is extended or adjusted under 35 U.S.C. 154(b) by 0 days.

(21) Appl. No.: 10/440,943

(22) Filed: May 20, 2003

(65) Prior Publication Data

US 2004/0231163 A1 Nov. 25, 2004

(51) Int. Cl.[7] ..... B26B 13/00
(52) U.S. Cl. ..... 30/146; 30/122
(58) Field of Search ..... 30/146, 142, 298.4, 30/296.1, 255, 122; 7/118–120; 24/3.11

(56) References Cited

U.S. PATENT DOCUMENTS 631,403 A * 8/1899 Metcalf ..... 30/146
5,628,117 A * 5/1997 Glesser ..... 30/298.4
6,698,099 B2 * 3/2004 Ronan et al. ..... 30/122
2001/0037542 A1 * 11/2001 Elliott ..... 24/3.11
2003/0101590 A1 * 6/2003 Ronan et al. ..... 30/122

FOREIGN PATENT DOCUMENTS

JP 2000-153081 6/2000

* cited by examiner

*Primary Examiner*—Douglas D Watts
(74) *Attorney, Agent, or Firm*—Vidas, Arrett & Steinkraus, PA

(57) ABSTRACT

A folding knife has a handle, as well as, a first blade and a second blade, which are rotatably supported by the handle. When the first blade is located in the fold-out position and the second blade is located in the fold-in position, the first blade functions as a knife. When both the first blade and the second blade are located in the fold-out positions, the first blade and the second blade cooperate with each other so as to function as a pair of scissors. The folding knife provided merely with a pair of blades can function not only as a knife but also as a pair of scissors in spite of its simple structure. Thus, the folding knife is reduced in number of parts and is simplified in structure.

18 Claims, 5 Drawing Sheets

KNIFE WITH FUNCTION OF SCISSORS

BACKGROUND OF THE INVENTION

The present invention relates to a knife having a scissors function.

There are multipurpose knives of prior art with a plurality of functions, such as of knife, scissors, and driver. In such a multipurpose knife, a handle rotatably supports implements having various functions. Each implement can be folded into the handle and out of the handle. When the implement is folded into the handle, the implement is in a fold-in position (idling position). When the implement is folded out of the handle, the implement is in a fold-out position (active position).

A conventional multipurpose knife having, for example, a knife function and a scissors function is provided with three blades, one of which functions as a knife and the other two blades function as a pair of scissors. Thus, multipurpose knives generally require a number of parts and have intricate structures, leading to increase in sizes and manufacturing costs of the multipurpose knives. Therefore, a multipurpose knife has been desired that has a simpler structure.

Japanese Laid-open Patent Publication No. 2000-153081 discloses a foldable scissors having a handle and a pair of blades that are supported to be rotatable with respect to the handle between the idling position and the active position. However, in the scissors disclosed in this publication, the pair of blades always moves interlocking with each other between the idling position and the active position, so that the scissors have no other function. That is, the scissors disclosed in the above official gazette do not have a function of knife.

SUMMARY OF THE INVENTION

An objective of the present invention is to provide a knife that is of a simple structure and has a function of scissors.

In order to attain the above objective, the knife according to the present invention includes a handle, a first blade attached to the handle such that it locates at least in an active position where the first blade extends from the handle, and a second blade attached to the handle. The second blade is rotatable with respect to the handle between an idling position where the second blade is retracted in the handle and an active position where the second blade extends from the handle. The first blade functions as a knife when the second blade is located in the idling position. The first blade and the second blade cooperate with each other so as to function as a pair of scissors when the second blade is located in the active position.

According to another aspect of the present invention, the knife includes a handle having a spine, the handle having a distal end and a proximal end, a blade extending from the distal end of the handle, a hook provided at the proximal end of the handle, and a latch provided at the proximal end of the handle. The latch is rotatable between a closed position where it closes an opening of the hook and an open position where it opens the opening of the hook. The spine has a resilient engaging portion engaging with the latch, and the resilient engaging portion urges the latch from the open position toward the closed position.

BRIEF DESCRIPTION OF THE DRAWINGS

The features of the present invention that are believed to be novel will be come apparent particularly by reading the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

Figure 1:
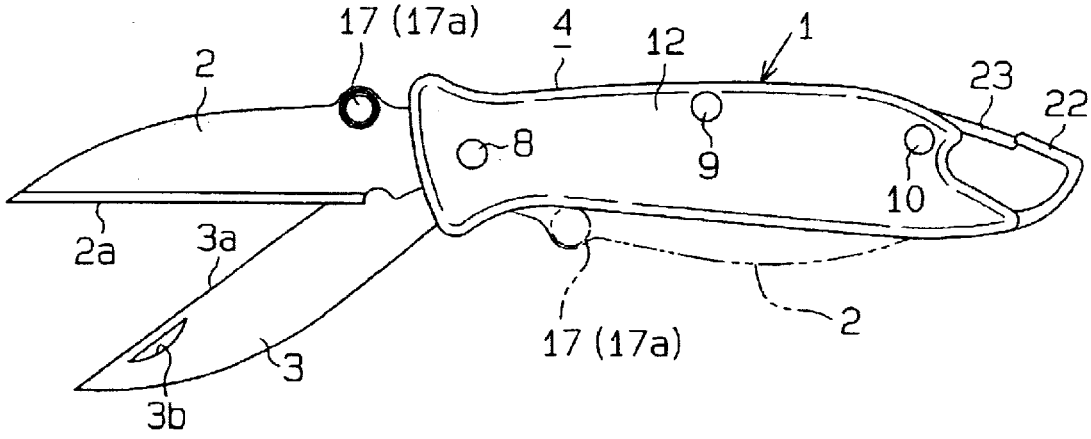
FIG. 1 is a front view of a folding knife according to a first embodiment of the present invention, in which a first blade and a second blade are in the fold-out positions.
Figure 2:
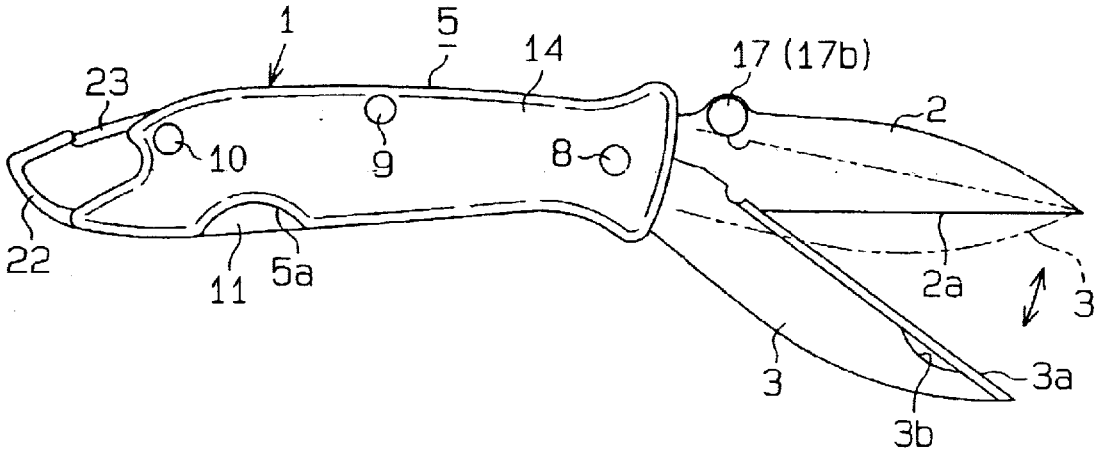
FIG. 2 is a back view of the knife shown in FIG. 1.

A first embodiment of the present invention will be described below referring to FIGS. 1 to 8. As shown in FIGS. 1 to 8, the knife of this embodiment is designed to have a foldable structure. The folding knife is provided with a handle 1, a first blade 2, and a second blade 3, which are rotatably connected to the distal end portion of the handle 1. The first blade 2 can move between the fold-in position (where the first blade 2 is housed in a recess 1*a* of the handle 1; see FIG. 5) and the fold-out position (where the first blade 2 extends from the handle 1; see FIGS. 1 to 4(B) and 7). The second blade 3 can also move between the fold-in position (where the second blade 3 is housed in the recess 1*a* of the handle 1; see FIGS. 5 and 7) and a fold-out position (where the second blade 3 extends from the handle 1; see FIGS. 1 to 4(B)). The fold-in positions correspond to the idling positions of the respective blades 2 and 3, whereas the fold-out positions correspond to the active positions of the respective blades 2 and 3.

The blades 2 and 3 are lapped over in close contact with each other. The blades 2 and 3 have cutting edges 2*a* and 3*a* respectively. The cutting edges 2*a* and 3*a* oppose each other in the posture shown in FIG. 1.

The handle 1 has a first side wall 4, a second side wall 5, a first spine 6, and a second spine 7. The first spine 6 and the second spine 7 are interposed between the upper edge of the side wall 4 and that of the side wall 5. With the spines 6 and 7, which are lapped over each other, being held between the side walls 4 and 5, they are connected to one another by a first connecting pin 8, a second connecting pin 9, and a third connecting pin 10. The side walls (4 and 5) and the spines (6 and 7) define the recess 1*a*. The first spine 6 and the first blade 2 are located on the same plane and are substantially of the same thickness. The second spine 7 and the second blade 3 are located on the same plane and are substantially of the same thickness.

Figure 3:
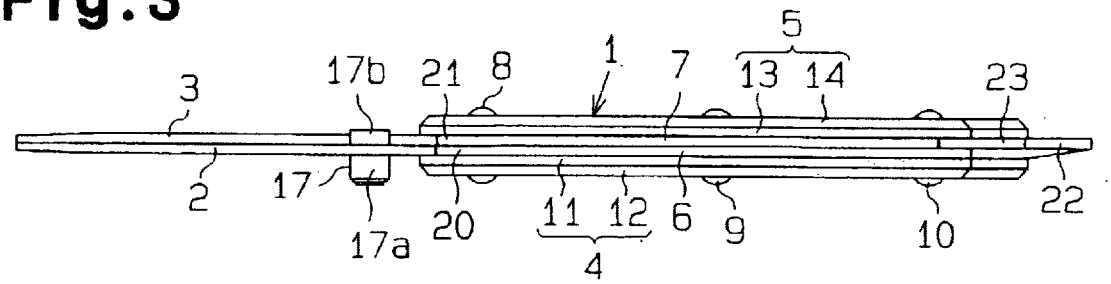
FIG. 3 is a plan view of the knife shown in FIG. 1.
Figure 8:
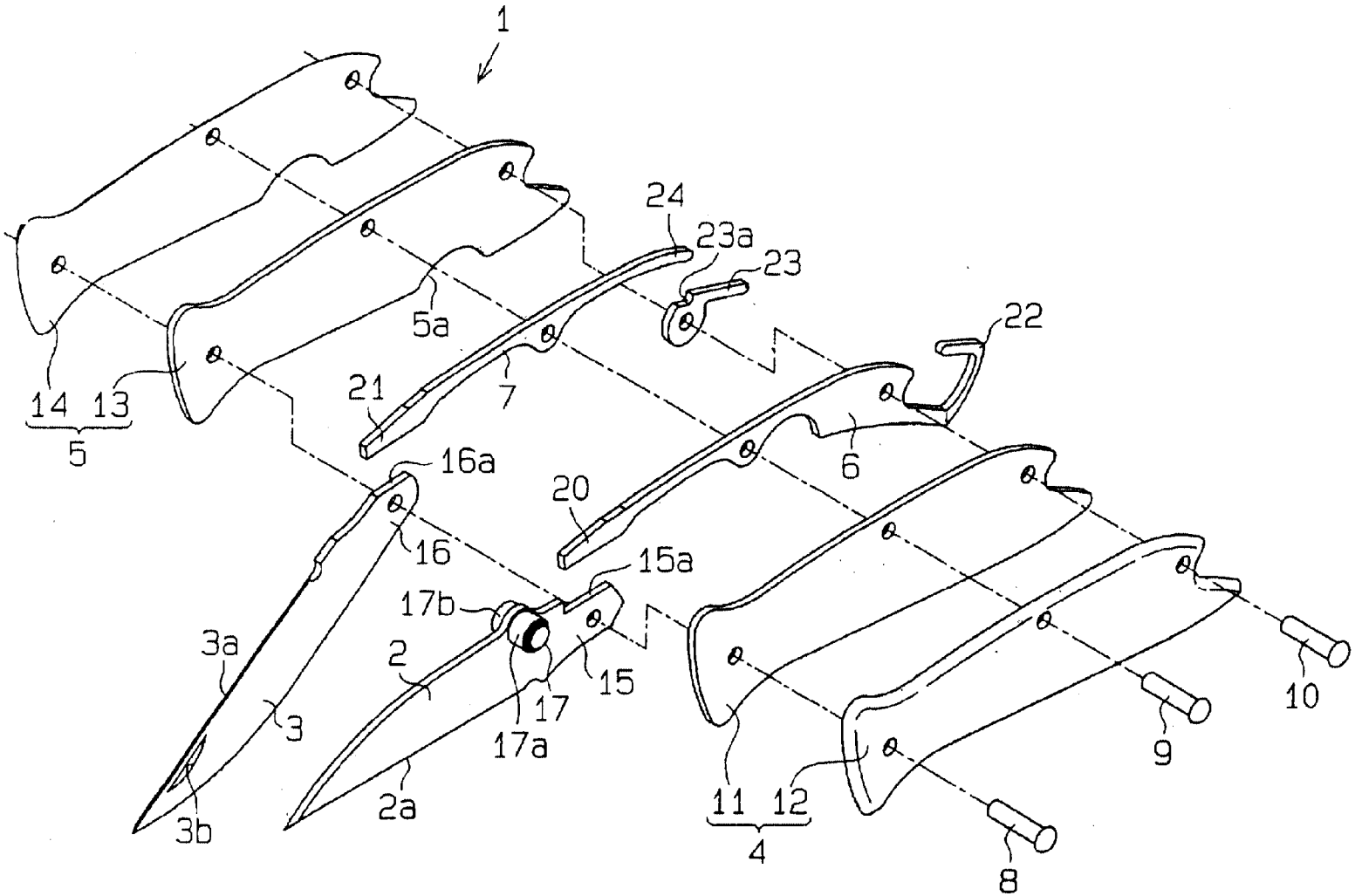
FIG. 8 is an exploded perspective view of the knife shown in FIG. 1.

As shown in FIGS. 3 and 8, the first side wall 4 contains a liner plate 11 and an outer plate 12, which is disposed in the outside of the liner 11. The second sidewall also contains a liner plate 13 and an outer plate 14, which is disposed in the outside of the liner 13. The liner plates 11 and 13 are preferably made of a metallic material. The outer plates 12 and 14 are preferably made of a synthetic resin material or wood. The spines 6 and 7 are made of a resilient material, preferably a metallic material.

As shown in FIGS. 1 to 8, the first connecting pin 8 penetrates the side walls (4 and 5) at the distal end portion of the handle 1. The second connecting pin 9 penetrates the side walls (4 and 5) and the spines (6 and 7) at the longitudinal middle part of the handle 1. The third connecting pin 10 penetrates the side walls (4 and 5) and the first spine 6 at the proximal end portion of the handle 1. Thus, the distal end of the first spine 6 assumes a free end, and the distal end and the proximal end of the second spine 7 assume free ends.

The first connecting pin 8 serves as a supporting shaft, which supports the first blade 2 and the second blade 3 to be rotatable with respect to the handle 1. As shown in FIGS. 4(A) to 8, the blades 2 and 3 have tongues 15 and 16 respectively. The tongues 15 and 16 are rotatably supported by the first connecting pin 8, or supporting shaft 8. The axis of the supporting shaft 8 is a pivotal axis of the blades 2 and 3. The tongues 15 and 16 are lapped over each other, and they are always located as such within the handle 1 and are held between the liner plates 11 and 13.

As shown in FIGS. 1 to 8, an engaging pin 17 protrudes from each side of the first blade 2 in the vicinity of the tongue 15. The engaging pin 17 contains a first stopper 17*a* and a second stopper 17*b*. The first stopper 17*a* and the second stopper 17*b* protrude from the distal side and from the proximal side of the first blade 2 with respect to the second blade 3. The first stopper 17*a* is engageable with the first side wall 4, and the second stopper 17*b* is engageable with the second blade 3.

Figure 4A:
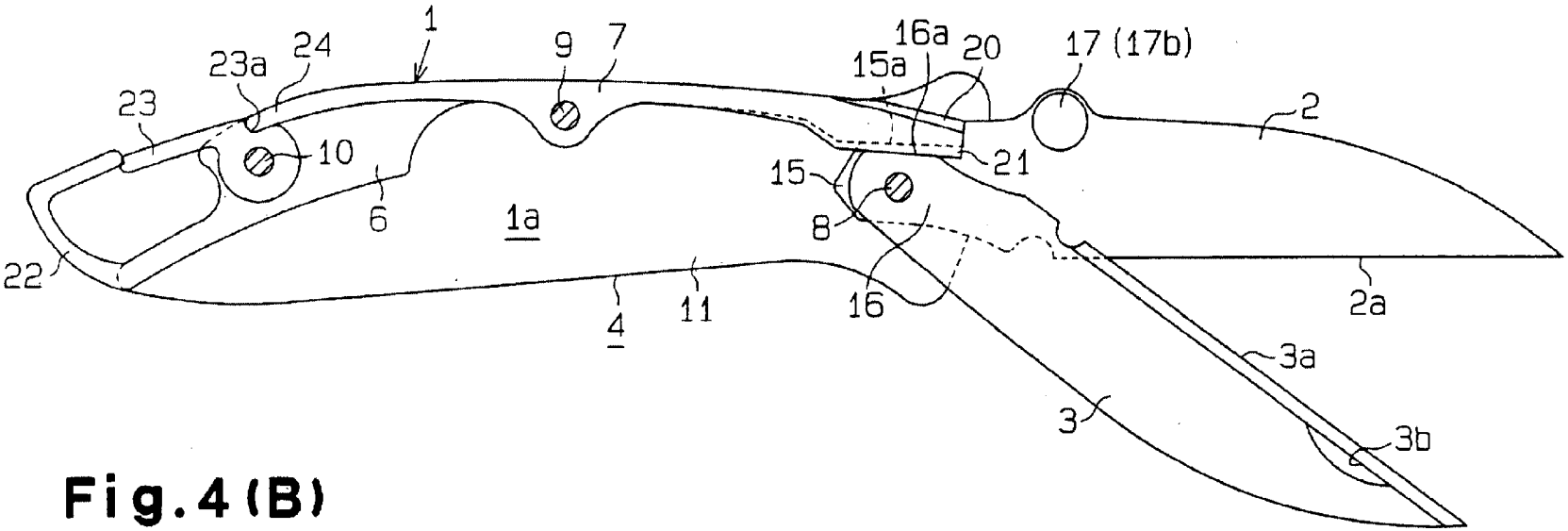
FIG. 4(A) is a cross-sectional back view of the knife shown in FIG. 2 from which a second side wall is removed.
Figure 4B:
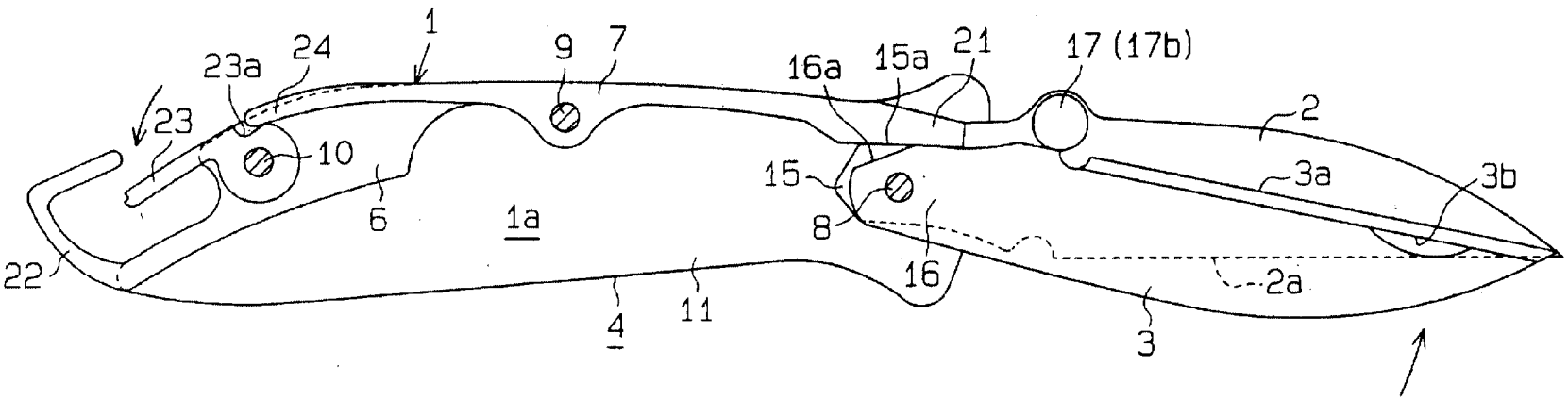
FIG. 4(B) is a cross-sectional back view of the knife shown in FIG. 4(A), in which the second blade is moved to a closed position.
Figure 5:
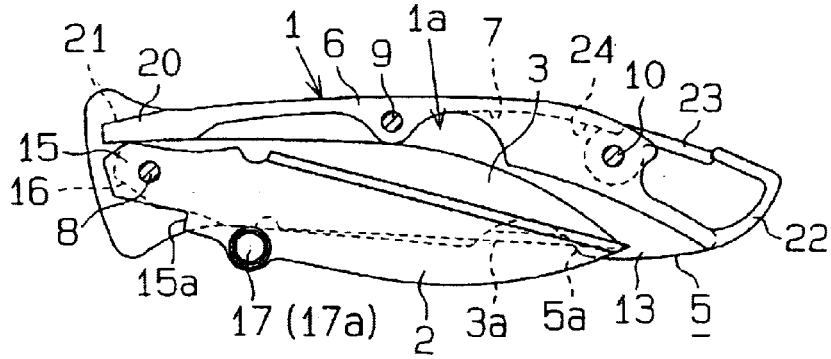
FIG. 5 is a cross-sectional front view of the knife, in which the first blade and the second blade are located in the fold-in positions.

As shown in FIGS. 4(A) to 8, the distal end (free end) of the first spine 6 functions as a first engaging portion 20 engaging with the outer edge of the tongue 15 of the first blade 2. The first engaging portion 20 is a spring, which resiliently presses the outer edge of the tongue 15. As shown in FIG. 5, in the state where the first blade 2 is located in the fold-in position, the first engaging portion 20 presses the tongue 15 such that it may apply to the first blade 2 a turning force toward the inside of the recess 1*a* (a counterclockwise force in FIG. 5). Meanwhile, the first stopper 17*a* engages with the first side wall 4 to prevent the first blade 2 from rotating over the fold-in position (see the chain double-dashed line in FIG. 1). Thus, the first blade 2 is held in the fold-in position by the pressure resiliently applied by the first engaging portion 20.

Figure 6:
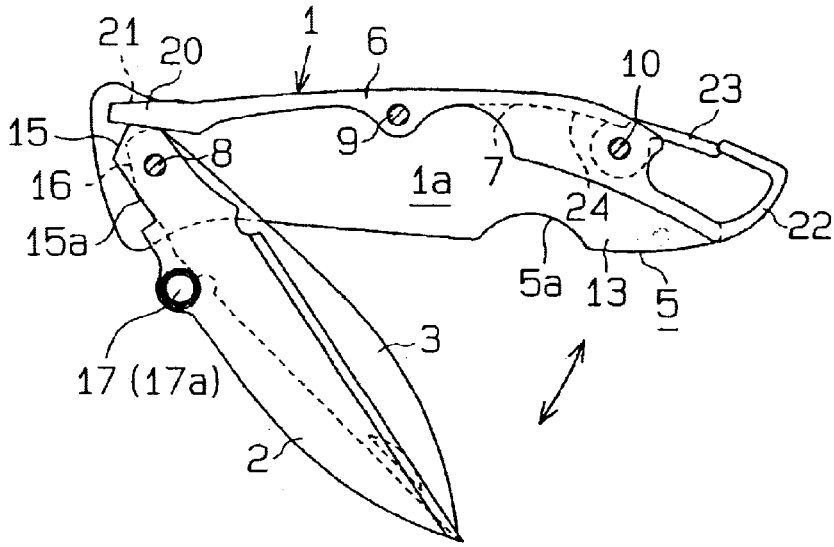
FIG. 6 is a cross-sectional front view of the knife shown in FIG. 1, in which the first blade and the second blade are located between the fold-in positions shown in FIG. 5 and the fold-out positions shown in FIG. 1.
Figure 7:
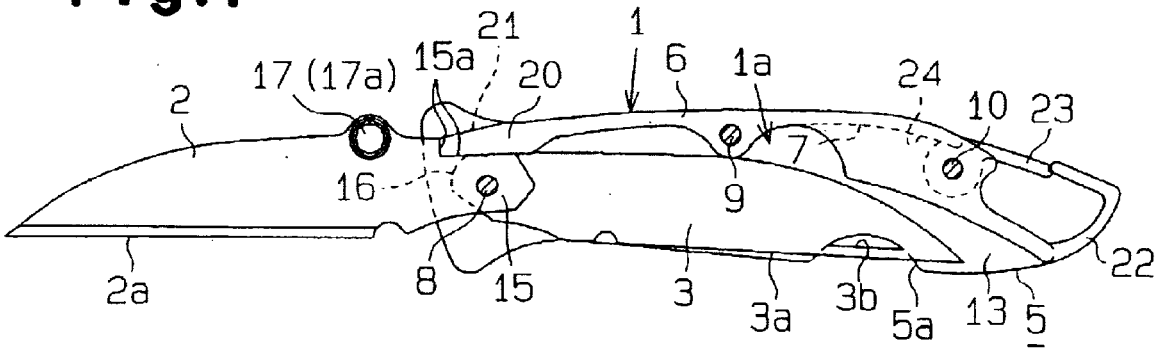
FIG. 7 is a cross-sectional front view of the knife shown in FIG. 1, in which only the first blade is located in the fold-out position.

When the first blade 2 is rotated clockwise from the fold-in position, shown in FIG. 5, it resists against the pressure of the first engaging portion 20; and the outer edge of the tongue 15 slides along the first engaging portion 20 while under the pressure of that first engaging portion 20 (see FIG. 6). Then, when the first blade 2 reaches the fold-out position as shown in FIG. 7, a holding portion 15*a* formed on the outer edge of the tongue 15 engages with the first engaging portion 20. The holding portion 15*a* contains two planes intersecting with each other so as to match the profile of the first engaging portion 20. Thus, the first blade 2 is prevented from rotating over the fold-out position and is held in the fold-out position by the pressure resiliently applied by the first engaging portion 20.

It should be noted here that a user can move the first blade 2 from the fold-in position to the fold-out position by pulling the exposed portion (the portion indicated by the chain double-dashed line in FIG. 1) of the first blade folded in the handle 1 or by pushing the first stopper 17*a* with a finger.

If the first blade 2 is rotated counterclockwise from the fold-out position, the first blade 2 can be returned to the fold-in position (shown in FIG. 5), as it resists against the pressure of the first engaging portion 20.

As shown in FIGS. 4(A) to 8, the front end (free end) of the second spine 7 functions as a second engaging portion 21 engaging with the outer edge of the tongue 16 of the second blade 3. The second engaging portion 21 is a spring that resiliently presses the outer edge of the tongue 16. As shown in FIGS. 5 and 7, in the state where the second blade 3 is located in the fold-in position, the second engaging portion 21 presses the tongue 16 such that it may apply to the second blade 3 a turning force toward the inside of the recess 1*a* (a counterclockwise force in FIGS. 5 and 7). Meanwhile, the rand (the other edge of the blade opposing the cutting edge 3*a* across the blade) of the second blade 3 engages with the second spine 7 to prevent the second blade 3 from rotating over the fold-in position. Thus, the second blade 3 is held in the fold-in position by the pressure resiliently applied by the second engaging portion 21. It should be noted here that, in FIGS. 5 to 7, the second engaging portion 21 is located behind the first engaging portion 20.

When the second blade 3 is rotated clockwise from the fold-in position shown in FIGS. 5 and 7, it resists against the pressure of the second engaging portion 21; and the outer edge of the tongue 16 slides along the second engaging portion 21 while under the pressure of that second engaging portion 21 (see FIG. 6). Then, when the second blade 3 reaches the fold-out position, a planar holding portion 16*a* formed on the outer edge of the tongue 16 engages with the second engaging portion 21 as shown in FIG. 4(A). Thus, the second blade 3 is held in the fold-out position shown in FIGS. 1 to 4(A) by the pressure resiliently applied by the second engaging portion 21.

As shown in FIGS. 2 and 5 to 8, an arcuate notch 5*a* is defined in the second side wall 5. A finger catch hole 3*b* is formed in the second blade 3. As shown in FIGS. 5 and 7, in the state where the second blade 3 is located in the fold-in position, the finger catch hole 3*b* is in alignment with the notch 5*a* of the second wall 5. A user can pull out the second blade 3 from the fold-in position to the fold-out position by catching, with one's finger or nail, the finger catch hole 3*b* exposed through the notch 5*a*. The finger catch hole 3*b* penetrating the second blade 3 may be replaced with a finger catch dent.

If the second blade 3 is rotated from the fold-out position toward the fold-in position, the second blade 3 can be returned to the fold-in position (shown in FIG. 7), as it resists against the pressure of the second engaging portion 21.

When both the first blade 2 and the second blade 3 are located in the fold-in positions as shown in FIG. 5, and the second blade 3 is pulled toward the fold-out position, the second stopper 17*b* engages with the second blade 3 so as to allow the first blade 2 to interlock with the second blade 3 as shown in FIG. 6 (the second stopper 17*b* is not shown in FIG. 6, since it is present behind the first stopper 17*a*). Thus, both of the blades 2 and 3 can be brought from the fold-in positions to the fold-out positions merely by pulling the second blade 3 from the fold-in position. In other words, the presence of the second stopper 17*b* prevents the second blade 3 from moving independently to the fold-out position with the first blade 2 remaining in the fold-in position.

Contrariwise, when both the first blade 2 and the second blade 3 are located in the fold-out positions as shown in FIGS. 1 to 4(A), and the first blade 2 is pulled toward the fold-in position, the second stopper 17*b* engages with the second blade 3 so as to allow the second blade 3 to interlock with the first blade 2 as shown in FIG. 6. Thus, both of the blades 2 and 3 can be brought at once from the fold-out positions to the fold-in positions merely by pulling the first blade 2 from the fold-out position to the fold-in position. In other words, the presence of the second stopper 17*b* prevents the first blade 2 from moving independently to the fold-in position with the second blade 3 remaining in the fold-out position.

Meanwhile, in the state where the second blade 3 is located in the fold-in position, the first blade 2 can be rotated independently between the fold-in position and the fold-out position (see FIGS. 5 and 7). Further, in the state where the first blade 2 is located in the fold-out position, the second blade 3 can be moved independently between the fold-in position and the fold-out position (see FIGS. 1 and 7).

In FIGS. 4(A) and 4(B), the first blade 2 and the second blade 3 are both located in the fold-out positions. However, FIG. 4(A) shows a state where the second blade 3 assumes an open position at a predetermined angle with respect to the first blade 2. FIG. 4(B) shows a state where the second blade 3 assumes a closed position with respect to the first blade 2. More specifically, the second blade 3 located in the fold-out position can rotate between the open position shown in FIG. 4(A) and the closed position shown in FIG. 4(B). As shown in FIG. 4(A), the second blade 3 is held in the open position under the pressure applied resiliently by the second engaging portion 21. In this state, if the second blade 3 is subject to a force directing from the open position toward the closed position, the second blade 3 is moved to the closed position, as it resists against the pressure of the second engaging portion 21 as shown in FIG. 4(B). The second stopper 17*b* engages with the second blade 3 brought to the closed position to prevent the second blade 3 from rotating over the closed position. When the second blade 3 is moved closer to the closed position than to the open position, the second engaging portion 21 presses the second blade 3 toward the open position so as to make the second blade 3 return to the open position.

As shown in FIGS. 4(A) to 8, a hook 22 is formed integrally with the proximal end of the first spine 6 such that it extends from the proximal end of the handle 1. A latch 23 is rotatably supported by the third connecting pin 10 so that it may locate on the same plane as that of the second spine 7. The latch 23 can pivot between a closed position (see FIG. 4(A)), where it closes the opening of the hook 22, and an open position (see FIG. 4(B)) where it opens the opening of the hook 22.

The rear end (free end) of the second spine 7 functions as a third engaging portion engaging with the latch 23. The third engaging portion 24 is a spring that resiliently presses the latch 23. As shown in FIG. 4(A), in the state where the latch 23 is located in the closed position, the third engaging portion 24 engages with a step-like holding portion 23*a* formed in the latch 23 to keep the latch 23 in the closed position. In this state, the latch 23 can be rotated to the open position shown in FIG. 4(B), as it resists against the pressure of the third engaging portion 24. Further, when the latch 23 is rotated closer to the open position than to the closed position, the third engaging portion 24 presses the latch 23 toward the closed position so as to return the latch 23 to the closed position.

The folding knife, having the constitution as described above, functions not only as a knife but also functions as a pair of scissors. More specifically, when the folding knife assuming the state where the blades 2 and 3 in the fold-in positions (see FIG. 5) is used as a knife, only the first blade 2 is rotated to the fold-out position as shown in FIG. 7. The first blade 2, brought to the fold-out position, functions as a knife.

Meanwhile, when the folding knife is used as a pair of scissors, the second blade 3 is rotated from the closed position as shown in FIG. 7 to the fold-out position (open position) as shown in FIGS. 1 to 4(A). Alternatively, the second blade 3 is rotated together with the first blade 2 from the closed position (shown in FIG. 5) to the fold-out position. The first blade 2 and the second blade 2 brought to the fold-out positions cooperate with each other so as to function as a pair of scissors. More specifically, a material to be cut can be severed between the cutting edge 2*a* of the blade 2 and the cutting edge 3*a* of the blade 3 by reciprocating the second blade 3 with respect to the first blade 2 between the open position shown in FIG. 4(A) and the closed position shown in FIG. 4(B).

The folding knife of the embodiment described above enjoys the following advantages.

When the first blade 2 is located in the fold-out position and the second blade 3 is located in the fold-in position, the first blade 2 functions as a knife. Meanwhile, when both the first blade 2 and the second blade 3 are located in the fold-out positions, the blades 2 and 3 cooperate with each other so as to function as a pair of scissors. Namely, the folding knife merely provided with a pair of blades 2 and 3 can function not only as a knife but also as a pair of scissors, in spite of its simple structure. Thus, the folding knife has a reduced number of parts and is simplified in structure, leading to downsizing of the knife and reduction of manufacturing cost thereof.

A part of the first spine 6 functions as an engaging member (resilient member) engaging with the first blade 2 so as to hold the first blade 2 in the fold-in position or in the fold-out position. Likewise, a part of the second spine 7 functions as an engaging member (resilient member) engaging with the second blade 3 so as to hold the second blade 3 in the fold-in position or in the fold-out position. Therefore, there is no need to provide extra engaging members (resilient members) for holding the blades 2 and 3 each in the predetermined positions. This also promotes reduction in number of parts and simplification of the structure.

The hook 22 is formed integrally with the first spine 6. Further, a part of the second spine 7 functions as an engaging member (resilient member) engaging with the latch 23 by which the hook 22 is opened and closed. These constitutions also contribute to reduction in number of parts and simplification of the structure.

Next, a folding knife according to a second embodiment of the present invention will be described referring to FIGS. 9 to 11 mainly by way of differences from the first embodiment shown in FIGS. 1 to 8. The elements corresponding to those in the first embodiment are each affixed with the same reference numbers.

Figure 9:
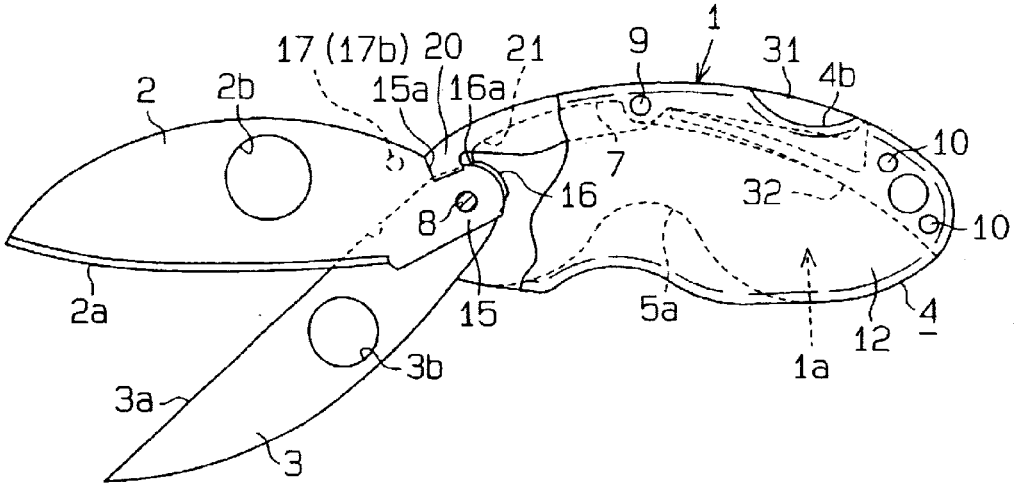
FIG. 9 is a partly cut-away front view of a folding knife according to a second embodiment of the present invention, in which the first blade and the second blade are in the fold-out positions.
Figure 10:
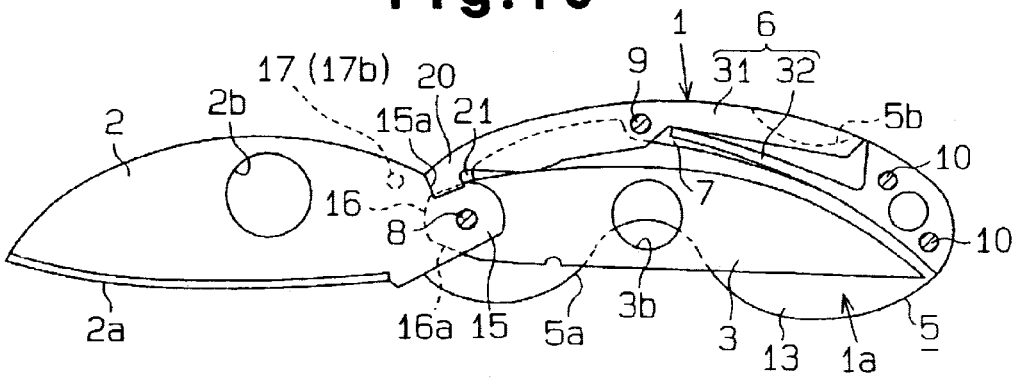
FIG. 10 is a cross-sectional front view of the knife shown in FIG. 9, in which only the first blade is located in the fold-out position.
Figure 11:
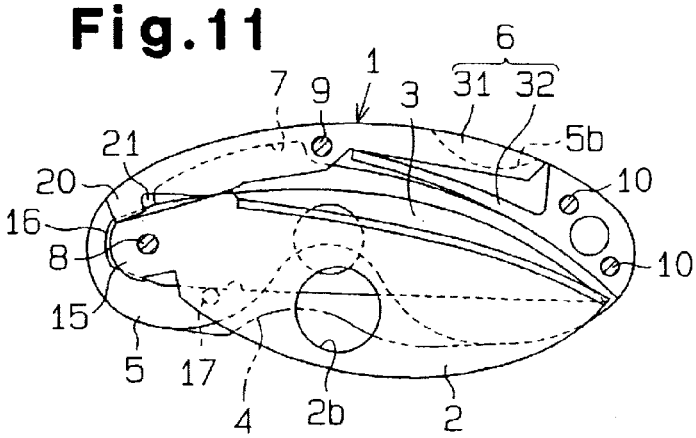
FIG. 11 is a cross-sectional front view of the knife shown in FIG. 9, in which the first blade and the second blade are located in the fold-in positions.

In this embodiment, the first spine 6 contains a lock plate 31 and a spring plate 32, as shown in FIGS. 9 to 11. The lock plate 31 is rotatably supported by the second connecting pin 9. The spring plate 32 is supported between the side walls 4 and 5 by a pair of third connecting pins 10 to urge the lock plate 31 counterclockwise in FIGS. 9 to 11. The first engaging portion 20 formed at the distal end of the lock plate 31 engages with the tongue 15 of the first blade 2. Thus, the lock plate 31 and the spring plate 32, like the first spine 6 in the first embodiment shown in FIGS. 1 to 8, serve as engaging members engaging with the first blade 2 so as to hold the first blade 2 in the fold-in position or in the fold-out position.

The side walls 4 and 5 have notches 4*b* and 5*b*, respectively, through which the lock plate 31 is exposed partly. When the lock plate 31 is pressed through these notches 4*b* and 5*b*, the lock plate 31 is rotated clockwise in FIGS. 9 and 10 to be disengaged from the first blade 2. In this state, the first blade 2 can be rotated from the fold-out position to the fold-in position.

In this embodiment, a finger catch hole 2*b* is defined in the first blade 2, and the hook 22 and the latch 23 are omitted. Further, the engaging pin 17 has no first stopper 17*a* but has the second stopper 17*b* which is engageable with only the second blade 3. The other parts are substantially the same as those in the first embodiment shown in FIGS. 1 to 8, although the shape of each element may differ from the counterpart in the first embodiment.

It should be noted here that in each of the embodiments shown in FIGS. 1 to 11, the first blade 2 may not be designed to be rotatable but may be fixed to the handle 1 so that it may locate in the fold-out position only. Substantially the same advantages as in the above embodiments can be obtained here again.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed:

1. A knife with a scissors function, the knife comprising:

a handle;

a first blade attached to the handle such that it locates at least in an active position where the first blade extends from the handle; and a second blade attached to the handle, wherein the second blade is rotatable with respect to the handle between an idling position where the second blade is retracted in the handle and an active position where the second blade extends from the handle, wherein the first blade functions as a knife when the first blade is located in the active position and the second blade is located in the idling position, and wherein the first blade and the second blade cooperate with each other so as to function as a pair of scissors when both the first blade and the second blade are located in the active positions.

2. The knife according to claim 1 further comprising an engaging member engaging with the second blade, wherein the engaging member presses resiliently the second blade so as to hold the second blade in the idling position or in the active position.

3. The knife according to claim 2, wherein the handle includes a spine, a part of which functions as the resilient engaging member.

4. The knife according to claim 2, wherein, when the second blade is located in the active position, the second blade is rotatable between an open position in a predetermined angle with respect to the first blade and a closed position with respect to the first blade, wherein, when the second blade is subject to a force directing from the open position toward the closed position, the second blade is moved to the closed position resisting against the pressure of the engaging member, and wherein, when the second blade is moved closer to the closed position than to the open position, the engaging member presses the second blade toward the open position so as to return the second blade to the open position.

5. The knife according to claim 4, wherein the second blade has a holding portion engageable with the engaging member when the second blade is in the open position so that the engaging member holds the second blade in the open position.

6. The knife according to claim 4, wherein the first blade has a stopper that is engageable with the second blade when the second blade is located in the closed position to prevent the second blade from rotating over the closed position.

7. The knife according to claim 1, wherein the first blade is rotatable with respect to the handle between the active position and an idling position where the first blade is retracted in the handle.

8. The knife according to claim 7 further comprising an engaging member engaging with the first blade, wherein the engaging member presses resiliently the first blade so as to hold the first blade in the idling position or in the active position.

9. The knife according to claim 8, wherein the handle includes a spine, a part of which functions as the resilient engaging member.

10. The knife according to claim 8, wherein the first blade has a holding portion engageable with the engaging member when the first blade is in the active position so that the engaging member holds the first blade in the active position.

11. The knife according to claim 7, wherein the first blade has a stopper engageable with the second blade, wherein, when the second blade is moved toward the active position in the state where the first blade and the second blade are located in the idling positions, the stopper engages with the second blade so as to allow the first blade to interlock with the second blade.

12. The knife according to claim 1, wherein the handle has a distal end to which the first blade and the second blade are attached and a proximal end opposite to the distal end, wherein a book is formed at the proximal end.

13. The knife according to claim 12, wherein the handle includes a spine, and wherein the hook is formed integrally with the spine.

14. The knife according to claim 12 further comprising:

a latch provided at the proximal end of the handle, wherein the latch is rotatable between a closed position where it closes an opening of the book and an open position where it opens the opening of the hook; and a resilient engaging member engageable with the latch, wherein the resilient engaging member urges the latch from the open position towards the closed position.

15. The knife according to claim 14, wherein the handle includes a spine, a part of which functions as the resilient engaging member.

16. A knife with a function of scissors, the knife comprising:

a handle including a first spine and a second spine;

a first blade attached to the handle, wherein the first blade is rotatable with respect to the handle between an idling position where the first blade is retracted in the handle and an active position where the first blade extends from the handle; and a second blade attached to the handle, wherein the second blade is rotatable with respect to the handle between an idling position where the second blade is retracted in the handle and an active position where the second blade extends from the handle, wherein the first spine has a first engaging portion engaging with the first blade, wherein the first engaging portion presses resiliently the first blade so as to hold the first blade in the idling position or in the active position, wherein the second spine has a second engaging portion engaging wit the second blade, wherein the second engaging portion presses resiliently the second blade so as to hold the second blade in the idling position or in the active position, and wherein the first blade functions as a knife when the first blade is located in the active position and the second blade is located in the idling position, and wherein the first blade and the second blade cooperate with each other so as to function as a pair of scissors when the first blade and the second blade are located in the active positions.

17. The knife according to claim 16, wherein the first blade has a stopper engageable with the second blade, wherein, when the second blade is moved toward the active position in the state where the first blade and the second blade are located in the idling positions, the stopper engages with the second blade so as to allow the first blade to interlock with the second blade.

18. The knife according to claim 16, wherein the handle has a distal end to which the first blade and the second blade are attached and a proximal end opposite to the distal end, the knife further comprising:

a hook formed integrally with the first spine so as to extend from the proximal end of the handle; and a latch provided at the proximal end of the handle, wherein the latch is rotatable between a closed position where it closes an opening of the hook and an open position where it opens the opening of the hook, wherein the second spine has a third engaging portion engaging with the latch, wherein the third engaging portion is resilient and urges the latch from the open position toward the closed position.

* * * * *

UNITED STATES PATENT AND TRADEMARK OFFICE

CERTIFICATE OF CORRECTION

PATENT NO. : 6,877,229 B2
DATED : April 12, 2005
INVENTOR(S) : Kimiyuki Sakai

It is certified that error appears in the above-identified patent and that said Letters Patent is hereby corrected as shown below:

Title page,
Item [73], Assignee, delete "Geber" and insert therefore -- Gerber --

Signed and Sealed this

Twenty-eighth Day of June, 2005

JON W. DUDAS
*Director of the United States Patent and Trademark Office*